US011248601B2

(12) United States Patent
Marinica et al.

(10) Patent No.: US 11,248,601 B2
(45) Date of Patent: Feb. 15, 2022

(54) PENDULUM OIL PUMP

(71) Applicant: Mahle International GmbH, Stuttgart (DE)

(72) Inventors: Liviu Marinica, Farmington Hills, MI (US); Mihajlo Soc, Windsor (CA); Steven Fletcher, Windsor (CA); Adam Rossetto, Lasalle (CA)

(73) Assignee: Mahle International GmbH

( * ) Notice: Subject to any disclaimer, the term of this patent is extended or adjusted under 35 U.S.C. 154(b) by 175 days.

(21) Appl. No.: 16/290,151

(22) Filed: Mar. 1, 2019

(65) Prior Publication Data

US 2020/0277954 A1 Sep. 3, 2020

(51) Int. Cl.

| | |
|---|---|
| ***F04C 2/32*** | (2006.01) |
| ***F01C 1/32*** | (2006.01) |
| ***F01C 1/46*** | (2006.01) |
| ***F04C 14/22*** | (2006.01) |
| ***F04C 2/352*** | (2006.01) |
| ***F04C 2/332*** | (2006.01) |

(52) U.S. Cl.

CPC ..... *F04C 2/332* (2013.01); *F04C 2230/60* (2013.01); *F04C 2230/85* (2013.01); *F04C 2240/30* (2013.01)

(58) Field of Classification Search

CPC ..... F04C 2/332; F04C 2/336; F04C 2/352; F04C 2240/801; F04C 14/22; F04C 18/352; F04C 28/22; F04C 2/46; F04C 14/226; F04C 2/324; F01C 1/321; F01C 1/322; F01C 1/328; F01C 1/344; F01C 1/324; F01C 1/332; F01C 1/46

See application file for complete search history.

(56) References Cited

U.S. PATENT DOCUMENTS

| | | | | |
|---|---|---|---|---|
| 3,901,630 | A * | 8/1975 | Kilmer | F01C 1/328 418/59 |
| 9,752,573 | B2 | 9/2017 | Hoehn et al. | |
| 10,018,199 | B2 | 7/2018 | Shinohara et al. | |

(Continued)

FOREIGN PATENT DOCUMENTS

| | | |
|---|---|---|
| DE | 102016209171 A1 | 11/2017 |
| DE | 102016221237 A1 | 5/2018 |

(Continued)

OTHER PUBLICATIONS

English translation of FR 848518 by Google translation Jul. 27, 2020.*

(Continued)

*Primary Examiner* — Deming Wan

(74) *Attorney, Agent, or Firm* — Fishman Stewart PLLC

(57) ABSTRACT

A pendulum pump includes a housing, a cover positioned on the housing and forming a cavity therebetween, an inner rotor and an outer rotor positioned within the cavity, wherein the inner rotor is connected via a plurality of pendulums to the outer rotor, and the pendulums are mounted to the outer rotor in an articulated manner such that a rotational eccentricity can be imparted between the inner rotor and the outer rotor to control a flow rate of the pendulum pump, and a protective plate positioned within the cavity and against a surface of one of the housing and the cover.

20 Claims, 6 Drawing Sheets

(56) References Cited

U.S. PATENT DOCUMENTS

| | | | | |
|---|---|---|---|---|
| 2009/0047141 | A1* | 2/2009 | Yamamuro | F04C 14/226<br>417/218 |
| 2010/0266434 | A1* | 10/2010 | Beez | F04C 2/332<br>418/24 |
| 2013/0089447 | A1* | 4/2013 | Yao | F01C 1/3447<br>418/54 |
| 2013/0343940 | A1* | 12/2013 | Ammon | F04C 14/226<br>418/27 |
| 2017/0328363 | A1 | 11/2017 | Morton | |

FOREIGN PATENT DOCUMENTS

| | | | | |
|---|---|---|---|---|
| FR | 848518 A | * | 10/1939 | F04C 2/332 |
| FR | 1054790 A | * | 2/1954 | F04C 2/321 |
| GB | 646407 A | * | 11/1950 | F04C 2/336 |

OTHER PUBLICATIONS

GB 646407-A Jun. 1, 2021.*
English translation of FR-1054790 by Espacenet Sep. 22, 2021.*
English Abstract for DE102013221237A1.
English Abstract for DE102016209171A1.

* cited by examiner

PENDULUM OIL PUMP

TECHNICAL FIELD

The present disclosure relates to a pendulum oil pump (sometimes referred to a pendulum slider pump), and more particularly to an apparatus for improving a pendulum oil pump.

BACKGROUND

Pendulum oil pumps are positive displacement pumps used in internal combustion engines, and due to their particular structure and operation are able to readily adapt volumetric output and pressure requirements to the needs of the internal engine. In general, a pendulum oil pump is a reciprocating pump that typically includes an inner rotor and an outer rotor. A plurality of pendulums is positioned between the inner and outer rotors and about an outer circumference of the inner rotor. The pendulums are rotationally affixed to an inner portion of the outer rotor at a first end of each pendulum, and a second end of the pendulum is typically positioned within a radial slot within the inner rotor.

The inner rotor is typically fixed on an axis and rotationally driven about the axis. The outer rotor is held in a spool, and a rotational eccentricity of the outer spool with respect to the inner rotor is controlled, thereby controlling delivery of oil passing through the pump. A cover is placed over the pump, which contains the flow of oil during and directs the flow from inlet to outlet. Volumetric output and pressure of the pendulum oil pump is adjusted by adjusting the eccentricity between the rotors.

In operation, when operating the pendulum oil pumps to increase output and pressure, the pendulum pumps are subject to damage and early life failure due to cavitation within the pump. That is, as oil is pumped cavitation tends to occur against the inner surface within the pump, such as in the housing and the cover. Cavitation can be a significant cause of wear and early life failure, where voids are formed and collapse during operation. The collapsing voids can cause significant pressure spikes due to implosion of the voids, which occur at or near the surfaces within the pump. The implosions can cause cyclical stress that can result in surface fatigue, damage, and early life structural failure of the pump.

To mitigate the effects of cavitation, in some known designs radial ribs have been placed along the surfaces, such as in the housing and/or in the cover. Such ribs can reduce the overall effect of cavitation by minimizing the space that is available for the cavitation to occur. Without such spaces, much larger cavitation voids can form during operation, which can significantly impact the destructive effect of cavitation.

However, the ribs themselves consume valuable space within the pump cavity, which can lead to reduced performance of the pendulum pump. That is, limiting the overall potential for cavitation can itself not only reduce the volumetric space available in the cavity for pumping, but can also reduce overall performance by limiting high end pressure capabilities of the pump.

Thus, there is a need to improve pendulum oil pumps.

DETAILED DESCRIPTION

Reference in the specification to "an exemplary illustration", an "example" or similar language means that a particular feature, structure, or characteristic described in connection with the exemplary approach is included in at least one illustration. The appearances of the phrase "in an illustration" or similar type language in various places in the specification are not necessarily all referring to the same illustration or example.

Various exemplary illustrations are provided herein of pendulum slider pump and a method of fabricating same.

In general, a pendulum slider pump includes an inner rotor which is connected via pendulums to an outer rotor. The pendulums are mounted on the outer rotor in an articulated manner and simultaneously guided with their pendulum foot in radial grooves in the inner rotor. The outer rotor, the inner rotor as well as pendulums adjacent in the circumferential direction accordingly delimit a pressure/suction chamber.

Figure 1:
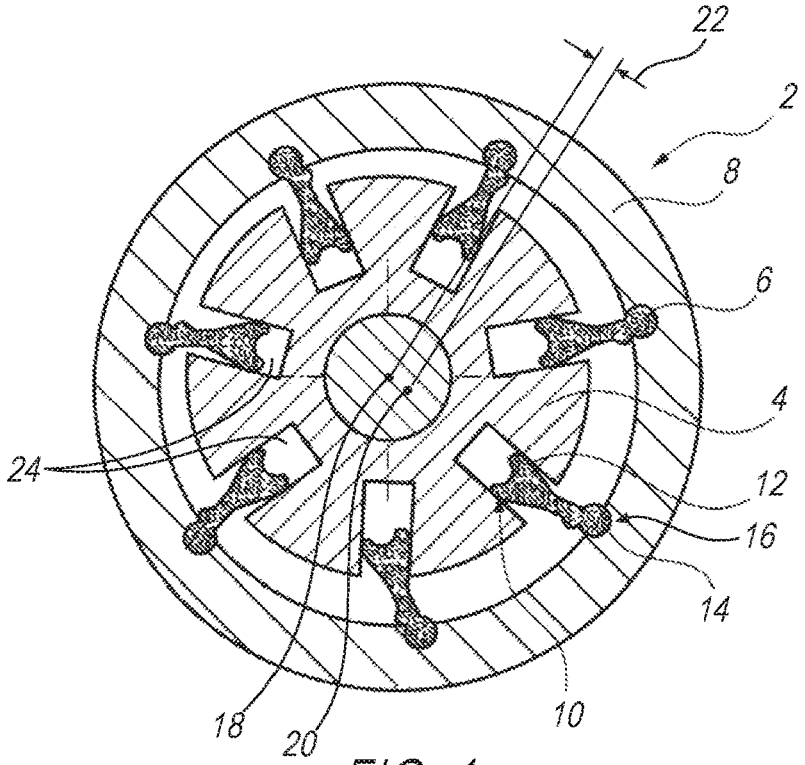
FIG. 1 shows elements of a pendulum slider pump.
Figure 2:
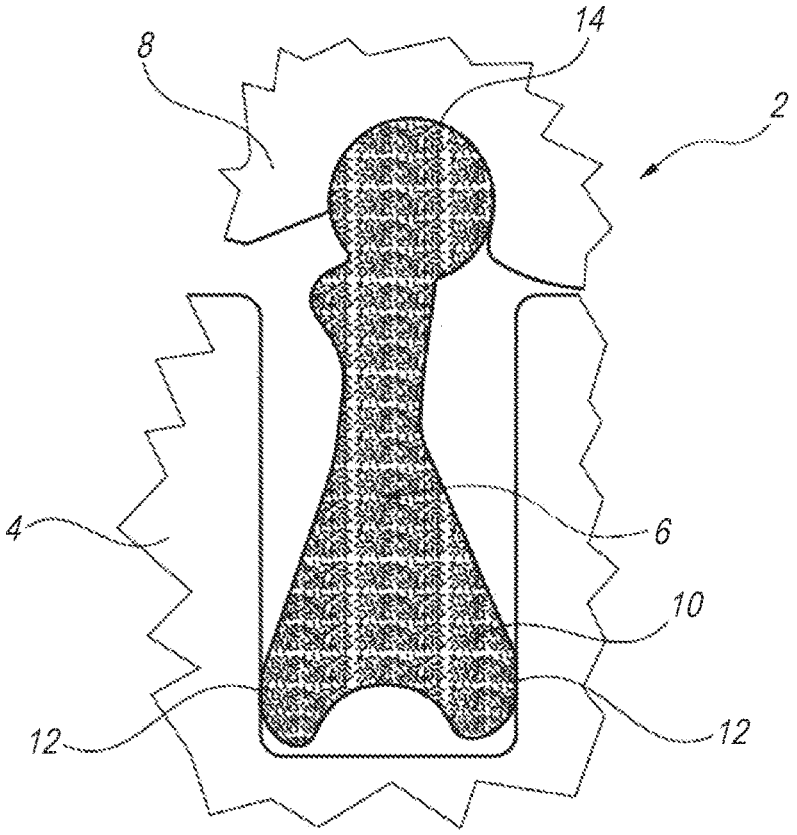
FIG. 2 shows details of a pendulum positioned within a radial groove for a pendulum slider pump.

Referring to FIGS. 1 and 2, a pendulum slider pump 2, which can be an oil pump in a motor vehicle as an example, includes an inner rotor 4, which via pendulums 6 is connected to an outer rotor 8. Pendulums 6 are mounted on outer rotor 8 in an articulated manner and with a pendulum foot 10 guided in a radial groove 12 in inner rotor 4. For an articulated mounting, pendulums 6 include a pendulum head 14, which is mounted in a corresponding joint socket 16 on outer rotor 8. Outer rotor 8, inner rotor 4 as well as two pendulums 6 adjacent a circumferential direction delimit a chamber (not visible), which is formed as a suction chamber or as pressure chamber depending on the rotary position.

Figure 3:
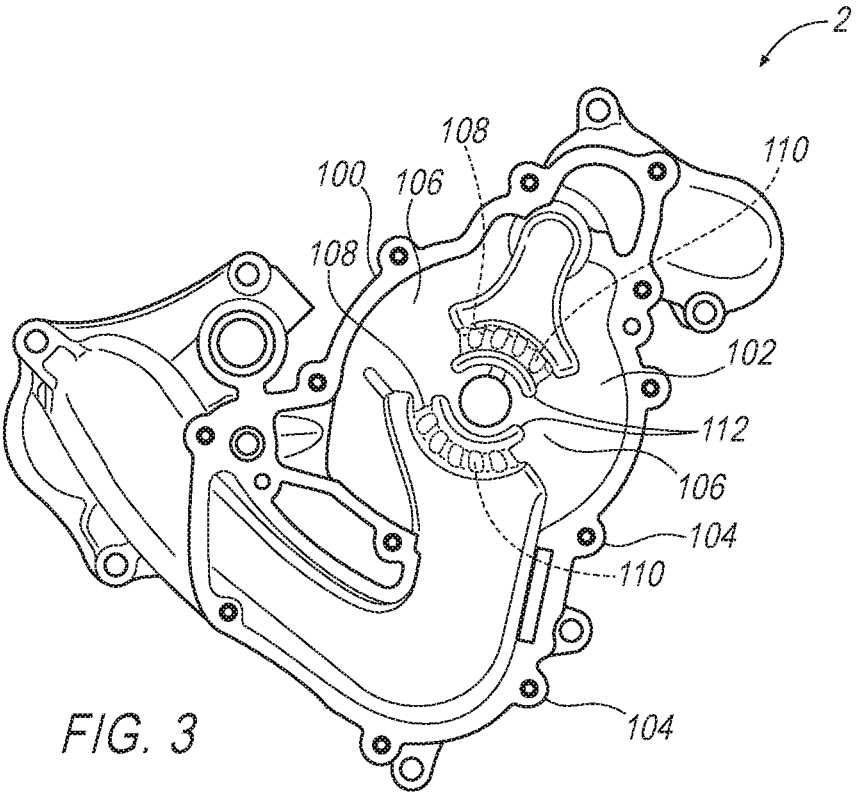
FIG. 3 shows a housing of a pendulum slider pump.
Figure 4:
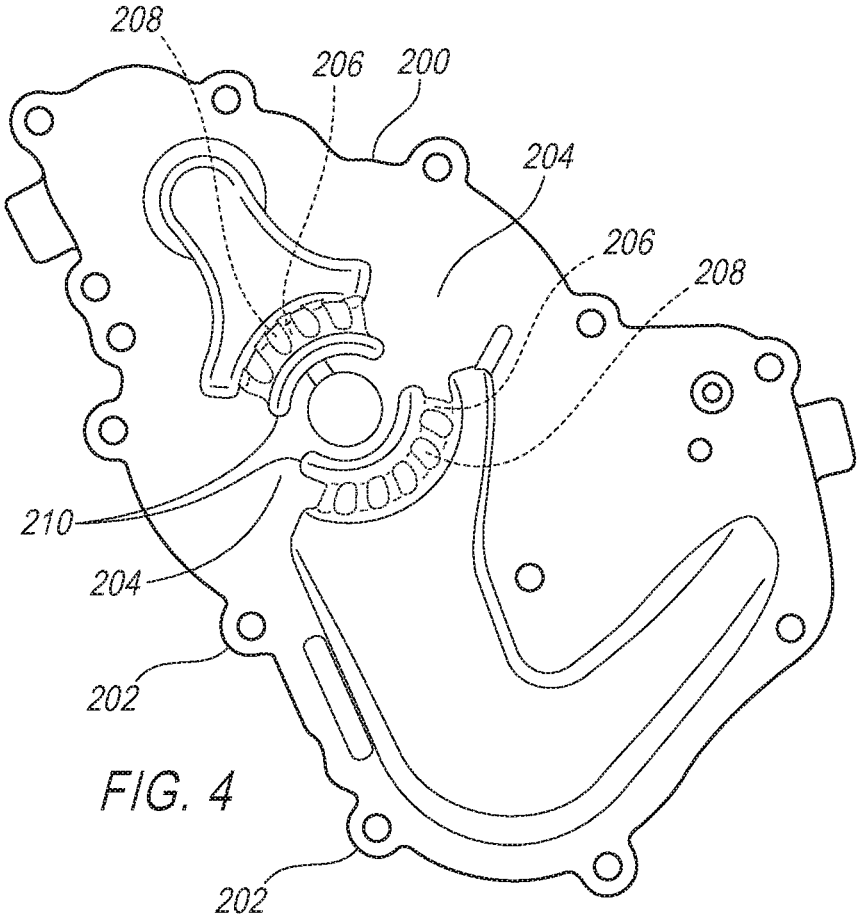
FIG. 4 shows a cover of a pendulum slider pump.

FIG. 3 illustrates a housing 100 of a pendulum slider pump 2, according to one example. Housing 100 includes, not shown, elements of pendulum slider pump 2 positioned within a cavity 102 as described with respect to FIGS. 1 and 2. Correspondingly, FIG. 4 shows a cover 200 that includes mounting holes 202 that match with mounting holes 104 of housing 100. Cover 200 is brought together against housing 100 and having pendulum pump slider 2 positioned therein. During operation, inner rotor 4 is caused to rotate, and referring back to FIG. 1, a center 18 of inner rotor 4 is caused to be offset from a center 20 of outer rotor 8, resulting in an eccentricity 22 therebetween. Eccentricity 22 is increased and decreased by increasing and decreasing the distance between centers 18 and 20. By adjusting eccentricity 22, volumes 24 between each pendulum 6 and its respective radial groove 12 are caused to increase and decrease during operation, depending on the amount of eccentricity 22, which impacts the volumetric flow rate of fluid pumped through pendulum slider pump 2. Volumes 24 thereby impart extremely low pressure suction upon the cover 200 and housing 100 that are above and below each volume 24, which can lead to cavitation and resulting cavitation damage in housing 100 and cover 200.

Thus, during operation and with relatively high volumetric flow rates, cavitation can occur along a surface 106 of housing 100, and/or along a surface 204 of cover 200. In one example, housing 100 may include ribs 108 that form small cavities 110 therebetween. Likewise, ribs 206 may be included on cover 200 that form small cavities 208 therebetween. In such fashion, if cavitation were to occur, then its impact may be minimized in that cavities 110, 208 thereby limit the space available for cavitation to propagate through. That is, without ribs 108/206 forming cavities 110/208, a much larger space is available and thus when conditions for cavitation occur, the void formed during cavitation may not be limited and the negative impact of cavitation can be compounded by large voids forming over surfaces 106, 204.

Figure 5:
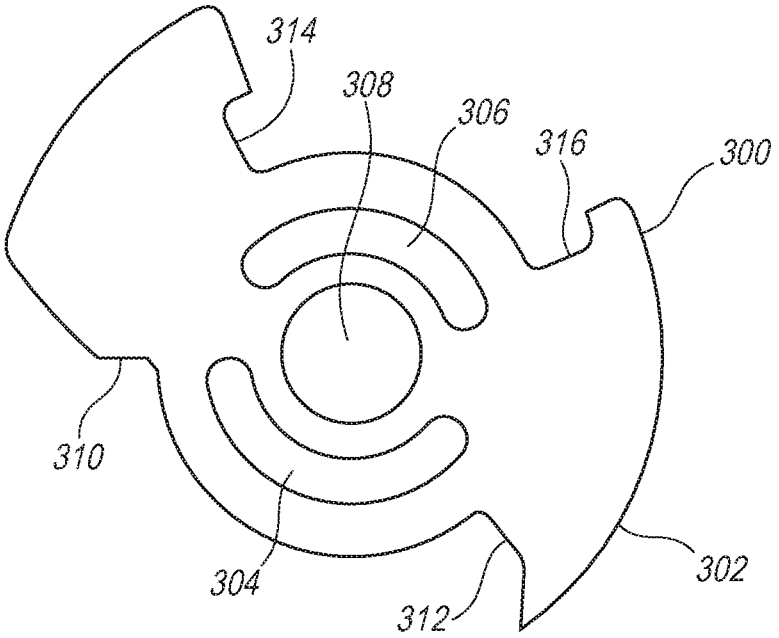
FIG. 5 shows a protective plate for installation onto one or both of the housing and cover of the pendulum slider pump.

As such, and according to the disclosure, a protective plate 300, shown in FIG. 5, may be positioned against one or both of surfaces 106, 204, to prevent damage that may be caused to surfaces 106, 204 from cavitation. In so doing, ribs 108/206 are not necessary within pump 2, as the negative effects from cavitation can be mitigated, eliminating damage to surfaces 106, 204. Referring to FIG. 5, a plate 300 includes an outer profile 302 of a protective plate that is configured to fit within a pocket or cavity that is formed between a pendulum pump housing and its cover. In one example, plate 300 is identical whether it is attached to the housing or the cover, which presumes that the housing and cover form a cavity in a fashion that can receive outer profile 302. Thus, in one example the housing, such as housing 100, and its cover, such as cover 200, thereby may be configured to receive plate 300 positioned against one, the other, or both housing 100 and cover 200. However, in another example, each of housing 100 and cover 200 may include different profiles for receiving a cover, such as cover 300. In this example, separate covers having separate profiles 302 may be included, each of which thereby conforms with a pocket or receiving feature to receive its respective cover.

In one example, protective plate may be a few thousandths of an inch thick (i.e., 100-200 microns), to several times that thickness. The thickness is thereby selected based on such properties as the material's propensity to withstand the punishing effects of cavitation, while still providing ample space within the cavity for the pendulum pump to properly function. The thickness of one or both covers 300 may thereby be selected based on the material used, versus its ability to withstand damage in a cavitation environment. Thus, a high-grade stainless steel having a very high resistance to damage and wear from cavitation, may have a lesser thickness than that of a lower grade steel that may be more prone to corrosion, erosion, or other wear mechanisms.

In addition, not only is the outer profile 302 determined based on the fit of protective cover 300 within the available space for positioning against cover 200 and/or housing 100, but protective cover 300 includes cuttout regions 304, 306, and 308. Cuttout regions 304, 306, for instance, are selected to mate or match with protruding regions 112 (FIG. 3) and/or protruding regions 210 (FIG. 4) of housing 100 and cover 200. In one example, cuttout regions 310, 312, 314, and 316 may be positioned, likewise, to match with protruding regions of housing 100 and/or cover 200. It is contemplated, however, that profile 302 of protective plate 300, is established to provide protection in regions of cavity 102 that have the greatest propensity for cavitation to occur. In other words, profile 302 is not selected to merely cover all surfaces within cavity 102 and on surfaces of housing 100 or cover 200. Rather, protective plate 300 and its profile 312 are selected to provide maximum protection, while leaving portions, such as regions 318, 320, and 322, without a protective cover. That is, regions 318, 320, 322 themselves experience changes in pressure during the pumping operation of pendulum slider pump 2, but it is contemplated that protection may not be necessary at all locations within cavity 102. Thus, a trade-off may be made in selection of the pump cover 300, to provide sufficient protection against cavitation during the life of the pump, while not providing material or protective covering to portions within the cavity that are not particularly prone to cavitation.

It is also contemplated that, while the cover is illustrated and described as a separate component from the housing and cover, such protection may be provided directly to the interior surface, according to the disclosure, such as via electroplating or other plating processes.

Figure 6:
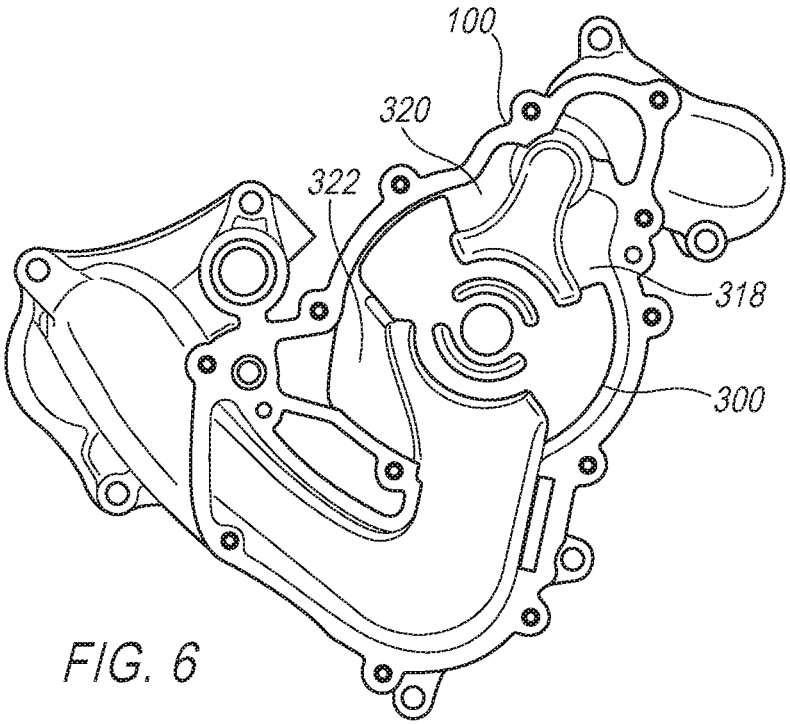
FIG. 6 shows the housing of FIG. 3 having the protective plate of FIG. 5 positioned thereon.
Figure 7:
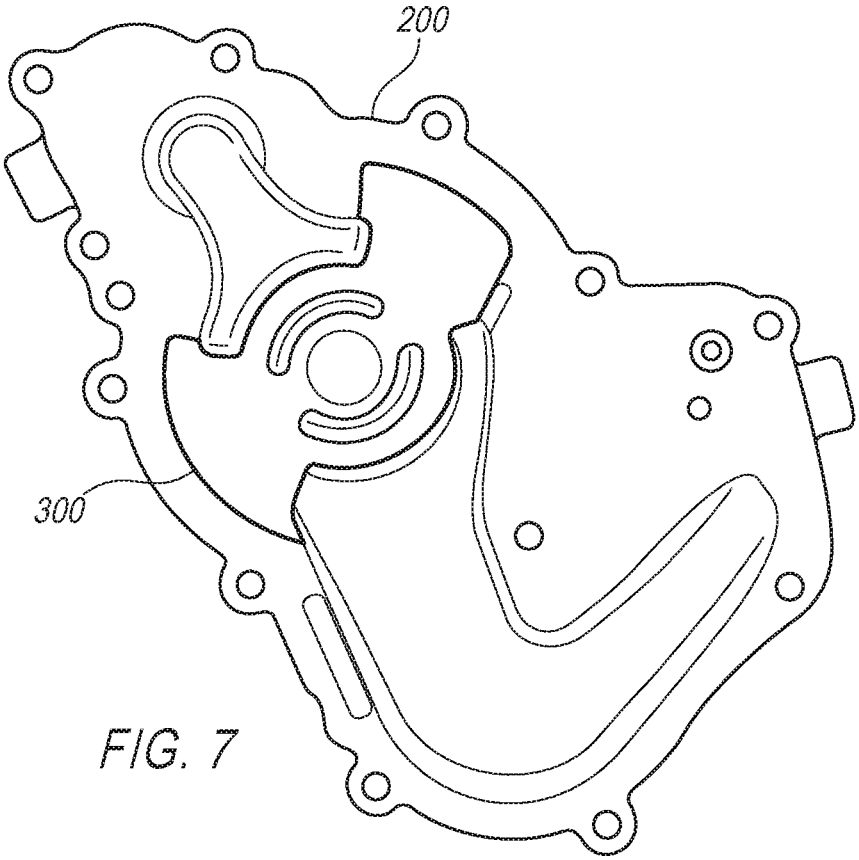
FIG. 7 shows the cover of FIG. 4 having the protective plate of FIG. 5 positioned thereon.

FIG. 6 thereby illustrates housing 100 having protective plate 300 installed therein and against surface 106. FIG. 7 illustrates cover 200 having protective plate 300 installed therein and against surface 204.

Thus, according to the disclosure, a pendulum pump 2 includes housing 100 and cover 200 positioned on housing 100 and forming a cavity 102 therebetween. Pendulum pump 2 includes inner rotor 4 and outer rotor 8 positioned within cavity 102. Inner rotor 4 is connected via a plurality of pendulums 6 to outer rotor 8, and pendulums 6 are mounted to outer rotor 8 in an articulated manner such that rotational eccentricity 22 can be imparted between inner rotor 4 and outer rotor 8 to control a flow rate of pendulum pump 2. Protective plate 300 is positioned within cavity 102 and against one or both of surfaces 106, 204 of one of housing 100 and cover 200.

In one example, protective plate 300 is positioned against surface 106 of housing 100. In another example, protective plate 300 is positioned against surface 204 of housing cover 200. In still another example, two protective plates 300 may be used, having one 300 positioned against surface 106 of housing 100, and another protective plate 300 positioned against surface 204 of housing cover 200. Also, according to the disclosure, protective plate 300 is steel, and at least one of housing 100 and cover 200 is aluminum.

Also disclosed is a method of fabricating a pendulum pump. The method includes positioning cover 200 on housing 100 and forming a cavity 102 therebetween. The method further includes positioning inner rotor 4 and outer rotor 8 within cavity 102, connecting inner rotor 4 to outer rotor 8 via pendulums 6, mounting pendulums 6 to outer rotor 8 in an articulated manner such that rotational eccentricity 22 can be imparted between inner rotor 4 and outer rotor 8 to control a flow rate of pendulum pump 2, and positioning protective plate 300 within 102 cavity and against a surface 106, 204 of one of housing 100 and cover 200.

Disclosed also is a method of refurbishing pendulum pump 2, which includes disassembling cover 200, housing 100, inner rotor 4, outer rotor 8, and pendulums 6 of pendulum pump 2. The method further includes positioning cover 200 on housing 100 and forming cavity 102 therebetween, positioning inner rotor 4 and outer rotor 8 within cavity 102, connecting inner rotor 4 to outer rotor 8 via pendulums 6, mounting pendulums 6 to outer rotor 8 in an articulated manner such that rotational eccentricity 22 can be imparted between inner rotor 4 and outer rotor 8 to control a flow rate of pendulum pump 2, and positioning protective plate 300 within 102 cavity and against a surface 106, 204 of one of housing 100 and cover 200.

Figure 8:
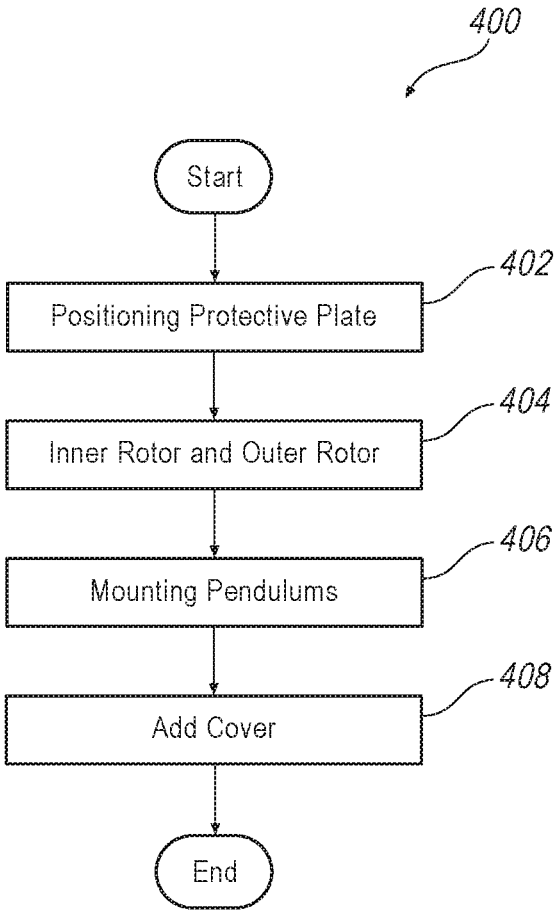
FIG. 8 shows steps of a method of fabricating a pendulum slider pump.

Referring to FIG. 8, a method 400 of fabricating a pendulum pump includes 402 positioning a protective plate against a surface of one or both of a housing and a cover. Method 400 further includes 404 positioning an inner rotor with respect to an outer rotor, step 406 mounting pendulums therebetween in an articulated manner such that a rotational eccentricity can be imparted between the inner rotor and the outer rotor to control a flow rate of the pendulum pump, and step 408 placing a cover against a housing to form a cavity and against a surface of one of the housing and the cover.

Figure 9:
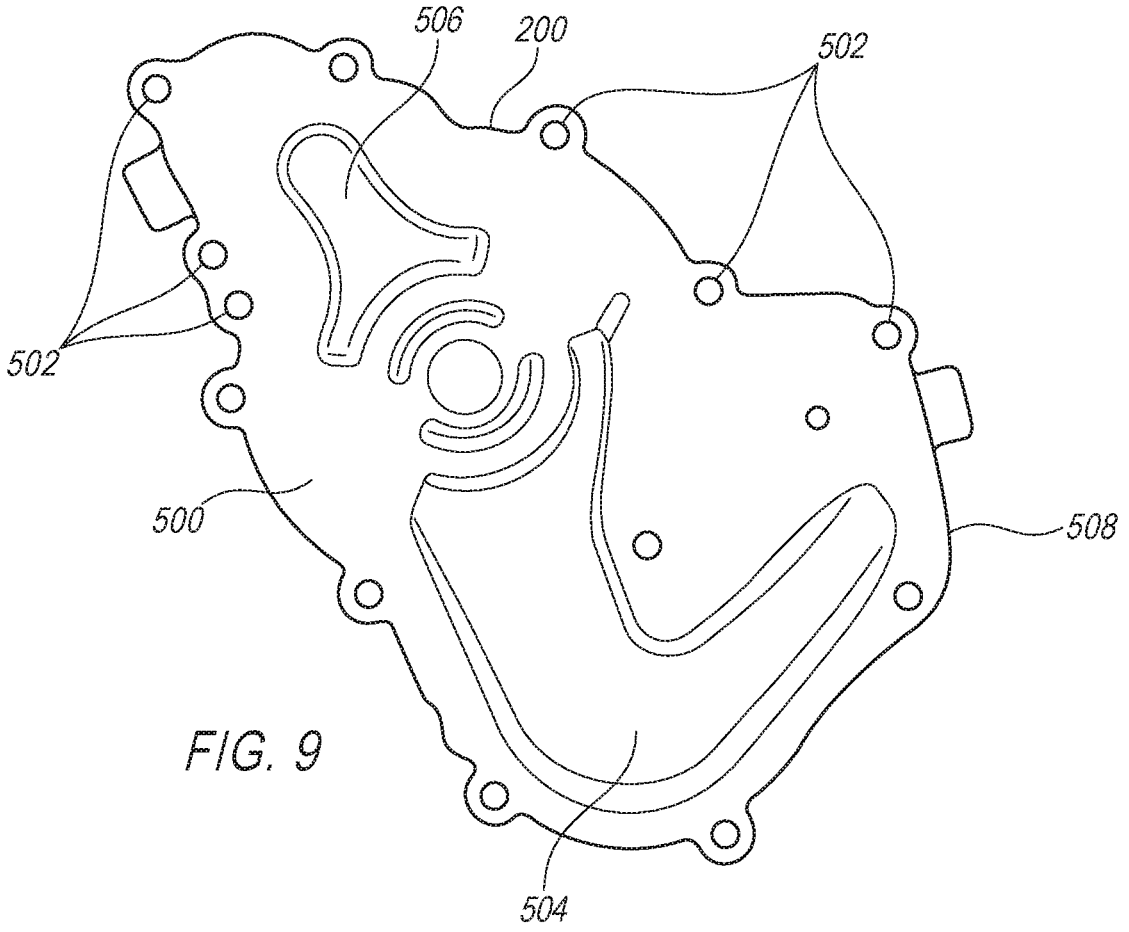
FIG. 9 shows the housing of FIG. 3 having a protective plate positioned thereon according to another example.

FIG. 9 illustrates cover 200 having a protective plate 500 installed thereon. In this example, however, protective plate 500 extends about an entire profile of cover 200, having clearance at hole locations 502 which match with corresponding hole locations such as shown in housing 100 of FIG. 3. Protective plate 500 extends about the entire profile 508 of cover 200 and includes cutaway sections 506, 508 that match with corresponding regions in cover 200, providing protection against cavitation as indicated, but installation is simplified in that protective plate 500 may be placed onto cover 200 during assembly, and then bolted or otherwise attached to housing 100 via its mating holes. Protective plate 500 thereby covers not only all corresponding cavities in housing 100, but further extends beyond the cavities, and in one example covers the entire profile. Thus, in one example protective plate 500 extends to an outer profile of one of the housing and the cover.

Thus, the disclosed method includes the steps, not necessarily in the following order, that include positioning a cover on a housing and forming a cavity therebetween, positioning an inner rotor and an outer rotor within the cavity, connecting the inner rotor to the outer rotor via a plurality of pendulums, mounting the pendulums to the outer rotor in an articulated manner such that a rotational eccentricity can be imparted between the inner rotor and the outer rotor to control a flow rate of the pendulum pump, and positioning a protective plate within the cavity and against a surface of one of the housing and the cover.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain arrangements and should in no way be construed so as to limit the claimed invention.

Accordingly, it is to be understood that the above description is intended to be illustrative and not restrictive. Many applications other than the examples provided would be upon reading the above description. It is anticipated and intended that future developments will occur in the arts discussed herein, and that the disclosed systems and methods will be incorporated into such future arrangements. In sum, it should be understood that the invention is capable of modification and variation.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A method of fabricating a pendulum pump, comprising:

positioning a cover on a housing and forming a cavity therebetween;

positioning an inner rotor and an outer rotor within the cavity;

connecting the inner rotor to the outer rotor via a plurality of pendulums;

mounting the pendulums to the outer rotor in an articulated manner such that a rotational eccentricity can be imparted between the inner rotor and the outer rotor to control a flow rate of the pendulum pump; and positioning a protective plate within the cavity, through which no fluid passes, and stationarily against a surface of one of the housing and the cover.

2. The method according to claim 1, wherein positioning the protective plate comprises positioning the protective plate against one of an inner surface of the housing an inner surface of the cover.

3. The method according to claim 1, further comprising positioning another protective plate within the cavity and against a surface of the other of the housing and the cover.

4. The method according to claim 1, wherein the protective plate is steel.

5. The method according to claim 1, wherein at least one of the housing and the cover are aluminum.

6. The method according to claim 1, wherein the surface is a single planar surface and the protective plate is positioned against the single planar surface.

7. The method according to claim 1, wherein positioning the protective plate within the cover further includes positioning the protective plate using cuttout regions that match with protruding regions of the housing or the cover.

8. A method of refurbishing a pendulum pump, comprising:

disassembling a cover, a housing, an inner rotor, an outer rotor, and a plurality of pendulums of a pendulum pump;

positioning the cover on the housing and forming a cavity therebetween;

positioning the inner rotor and the outer rotor within the cavity;

connecting the inner rotor to the outer rotor via the plurality of pendulums;

mounting the pendulums to the outer rotor in an articulated manner such that a rotational eccentricity can be imparted between the inner rotor and the outer rotor to control a flow rate of the pendulum pump; and positioning a protective plate within the cavity, through which no fluid passes, so that it is stationary against a surface of one of the housing and the cover.

9. The method according to claim 8, wherein positioning the protective plate comprises positioning the protective plate against one of an inner surface of the cover and an inner surface of the housing.

10. The method according to claim 8, further comprising positioning another protective plate within the cavity and against a surface of the other of the housing and the cover.

11. The method according to claim 8, wherein the protective plate is steel.

12. The method according to claim 8, wherein positioning the protective plate within the cover further includes positioning the protective plate using cuttout regions that match with protruding regions of the housing or the cover.

13. A pendulum pump, comprising:

a housing;

a cover positioned on the housing and forming a cavity therebetween;

an inner rotor and an outer rotor positioned within the cavity, wherein the inner rotor is connected via a plurality of pendulums to the outer rotor, and the pendulums are mounted to the outer rotor in an articulated manner such that a rotational eccentricity can be imparted between the inner rotor and the outer rotor to control a flow rate of the pendulum pump; and a protective plate positioned within the cavity and through which no fluid passes, and is stationary against a surface of one of the housing and the cover.

14. The pendulum pump according to claim 13, wherein the at least one surface is one of an inner surface of the cover and an inner surface of the housing.

15. The pendulum pump according to claim 13, further comprising another protective plate positioned within the cavity and against a surface of the other of the housing and the cover.

16. The pendulum pump according to claim 13, wherein the protective plate is steel.

17. The pendulum pump according to claim 13, wherein at least one of the housing and the cover are aluminum.

18. The pendulum pump according to claim 13, wherein the surface is a single planar surface and the protective plate is positioned against the single planar surface.

19. The pendulum pump according to claim 13, wherein the protective plate extends to an inner profile of one of the housing and the cover.

20. The pendulum pump according to claim 13, wherein the protective plate includes cuttout regions that match with protruding regions of the housing or the cover.

* * * * *